United States Patent [19]

Vlahos

[11] Patent Number: 4,743,809

[45] Date of Patent: May 10, 1988

[54] XENON LAMP CIRCUIT

[75] Inventor: Victor H. Vlahos, Lake Zurich, Ill.

[73] Assignee: Atlas Electric Devices Company, Chicago, Ill.

[21] Appl. No.: 78,547

[22] Filed: Jul. 28, 1987

[51] Int. Cl.[4] ..... H05B 37/02

[52] U.S. Cl. ..... 315/209 R; 315/247; 315/284; 315/DIG. 4; 73/865.6

[58] Field of Search ..... 315/209, DIG. 4, 284, 315/287, 247; 73/865.6; 374/57

[56] References Cited

U.S. PATENT DOCUMENTS

| | | | |
|---|---|---|---|
| 3,202,811 | 8/1965 | Hall | 73/865.6 |
| 3,662,216 | 5/1972 | Hildebrant | 315/284 |
| 4,675,579 | 6/1987 | Hardy et al. | 315/DIG. 4 |

*Primary Examiner*—Harold Dixon

*Attorney, Agent, or Firm*—Trexler, Bushnell, Giangiorgi & Blackstone, Ltd.

[57] ABSTRACT

A circuit for a Xenon lamp is disclosed comprising an inductor having first, second and third connectors between one terminal of the lamp and a power line, said first connector being connected to said power line, means connecting the third connector to a second terminal of the Xenon lamp, means including control conducting means connected between said second connector to either of said first and third connectors, and means for controlling the control conducting means to control shunting of said inductor between first and second power lines to control power input to the Xenon lamp.

3 Claims, 1 Drawing Sheet

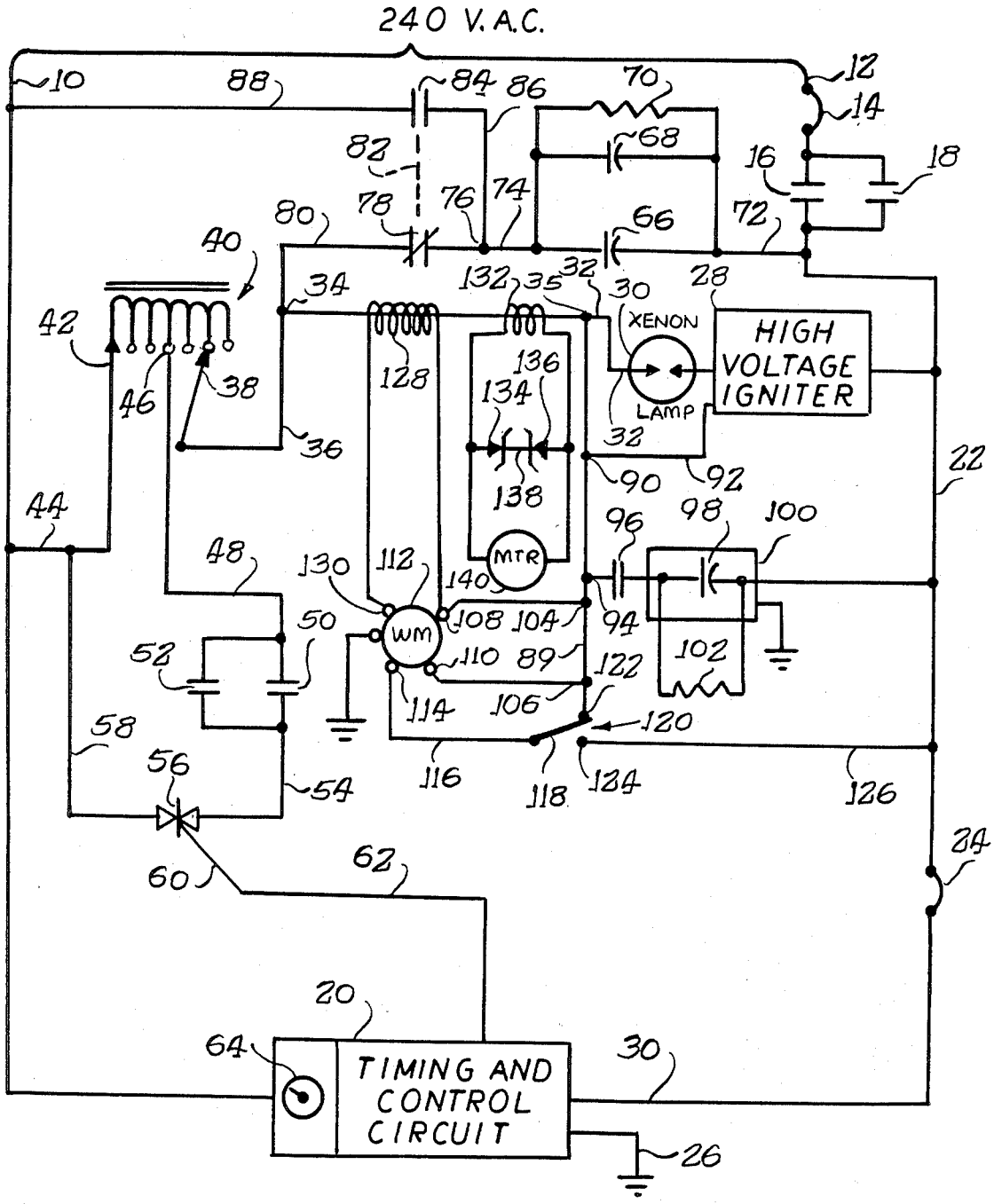
240 V.A.C.
XENON
LAMP
HIGH VOLTAGE IGNITER
MTR
WM
TIMING AND CONTROL CIRCUIT

XENON LAMP CIRCUIT

BACKGROUND OF THE INVENTION

Paints and other items exposed to sunlight have a tendency to fade. It is desirable for manufacturers who are using such items to know how fade-resistant a given product is. Certain tests can be made by exposure to sunlight. However, this generally can be done only in certain geographic locations. Accordingly, various test apparatus have been developed utilizing artificial lights, such as carbonarc or xenon lamps. One commercially successful line of such artificial light testing systems is manufactured and sold by Atlas Electric Devices of Chicago, Ill. under its trademark "WEATHER-OMETER", and reference is made particularly to the C-Series "WEATHER-OMETER" testing apparatus.

Such prior art testing apparatus have worked very well, but have been expensive to manufacture and to operate. In order to ignite the Xenon lamp and to be able to control a wattage range of such apparatus, it has been necessary to use a plurality of components, specifically a main reactor, an auxiliary reactor, a voltage booster transformer, and four 40 MFD capacitors. In such prior art apparatus the main reactor was used as the primarily voltage limiting agent to the Xenon lamp after ignition, thus enabling and obtaining the minimum wattage on the order of 2 KW-2.2 KW.

The voltage booster transformer was used to increase the voltage to the Xenon lamp by approximately 50 to 60 volts AC depending somewhat on the line voltage, and thus to help ignite the Xenon lamp and also to obtain increased wattage once the lamp has been ignited.

The auxiliary reactor was used as a shunt across the main reactor in order to increase the inductive reactance, and thus to increase the voltage to the Xenon lamp. This also increased the wattage to the lamp. The auxiliary reactor was shunted across the main reactor by the use of a proportional controlled silicon controlled rectifier (SCR) circuit.

The four 40 microfarad capacitors were used to obtain higher wattage ranges by connecting them across the Xenon lamp after ignition, and thus to increase the voltage across the lamp. As is known, the capacitors are charged to peak voltage, i.e. effective value times 1.414, thus increasing the wattage.

OBJECTS AND SUMMARY OF THE INVENTION

It is an object of the invention to provide a Xenon lamp circuit which is substantially less expensive to manufacture and maintain than prior art circuits. Specifically, it is an object of the invention to provide a Xenon lamp circuit for weather and fade testing purposes that uses but a single reactor.

In carrying out the present invention I have provided a Xenon lamp circuit having a single, tapped reactor serving both as a main reactor and a booster reactor, and also serving as an auto-transformer for boosting line voltage to provide maximum wattage from the lamp.

THE DRAWING

The present invention will best be understood from the following specification when taken in accompaniment with the single drawing FIGURE, which comprises an electrical wiring diagram of a circuit embodying the present invention.

DETAILED DESCRIPTION OF THE ILLUSTRATED EMBODIMENT

A nominal 240 volt AC supply force is illustrated comprising a pair of conductors 10 and 12. The conductor 12 is connected through a circuit breaker 14 to a pair of parallel sets of relay contacts 16 and 18. These contacts are normally opened and are closed at selective times by a control circuit 20 connected to a continuation 22 of the line 12 through a circuit breaker 24, and also connected to the line 10. The control circuit further is grounded at 26.

The continuation line 22 is connected through a high voltage ignitor 28 of known construction to a Xenon lamp 30 of a type well known for testing weather and fade resistance of products. The opposite side of the Xenon lamp is connected to a line or conductor 32 leading to a junction 34. This junction is connected by another line or conductor 36 to a variable tap 38 on an iron core inductor 40, comprising the main reactor, booster and auto transformer of the present invention. The inductor is provided with a second variable tap 42 connected to a line or conductor 44 leading to the supply line 10.

The inductor 40 is provided with an intermediate fixed tap 46 leading through a line or conductor 48 to a pair of parallel sets of relay contacts 50 and 52. These contact sets are normally open, and are respectively closed by controls in the control circuit 20. The opposite sides of the relay contacts 50 and 52 are connected by a line 54 to a pair of back-to-back silicon-controlled rectifiers (SCRs) 56. The opposite side of the back-to-back SCRs is connected through a line 58 to the line 44, and hence to the line 10. The gate or control element 60 for the SCRs is connected through a line 62 to the control circuit. A potentiometer 64 accessible to an operator of the control circuit controls the firing time of the back-to-back SCRs 56.

A pair of 40 MFD oil filled capacitors 66 and 68 are connected in parallel with one another and in parallel with a resistor 70, one end of the parallel combination being connected through a line or conductor 72 to the line 22. The opposite side of the parallel combination of capacitors and resistors is connected through a line 74 to a junction 76. The junction is in turn connected through the normally closed contacts 78 of a single throw double pole relay to a line 80 leading to the junction 34. The normally closed contacts 78 are mechanically connected at 82 to the normally opened contacts 84 of the same relay, one side of the normally opened contacts being connected by a line 86 to the junction 76 and the other side being connected by a line 88 to the line 10. The relay contacts 78 and 84 are suitably controlled by the control circuit 20.

The line 32 from the Xenon lamp 30 is provided with a junction 35 from which a line 89 extends. A junction 90 on the line 89 is connected by a line 92 to a connection on the high voltage ignitor 28. Another junction 94 on the line 88 is connected through normally open relay contacts 96 to a 44 MFD capacitor 98 within a grounded housing 100, and paralleled by a resistor 102. The resistor 102 is 56 KOHMS as is the resistor 70. The opposite side of the parallel combination of the resistor 102 and capacitor 98 is connected to the line 22.

The line 89 is provided with two additional junctions 104 and 106, respectively connected to connectors 108 and 110 on a wattmeter 112. An additional connector 114 on the wattmeter is connected by means of a line 116 to the movable switch contact 118 of a single pole double throw switch 120. One of the fixed contacts 122 of this switch is connected to line 89, while the other fixed contact 124 is connected by a line 126 to the line 22. A five turn current transformer coil 128 encircles the line 32, and has the opposite ends thereof connected to the connector 108 on the wattmeter, and an additional connector 130 on the wattmeter. Another current transformer coil 132 of two turns has the opposite sides thereof connected to the anodes of a pair of Zener diodes 134 and 136 which have the cathodes connected together by a conductor 138. A motor 140 is connected across the Zener diode combination and drives a cam which controls the opening and closing of microswitch contacts in the control circuit 20.

It will now be apparent that there is but a single main/booster reactor and no separate transformer used in the present circuit. The voltage booster transformer has been eliminated, and a capacitive discharge system is used to increase the voltage across the Xenon lamp during the ignition cycle only, this being for approximately 5 seconds. The three 40 MFD capacitors 66, 68 and 98 are charged to peak voltage (effective value, $\times 1.414$).

Once the Xenon lamp has been ignited the capacitor 98 is removed from the circuit by opening of the relay contacts 96 under control of the control circuit 20. At the same time the contacts 78 open and the contacts 84 close, whereby the two capacitors 66 and 68 are switched across the AC line. They then act as power factor correction which results in decreased power consumption by 7 to 10 AMPS, depending on the wattage range used, thereby materially reducing operating costs.

The inductor 40 is in series with the Xenon lamp during continuous operation, and determines the voltage to the lamp, and hence the wattage. The back-to-back SCRs 56 from the input terminal 42 to the shunt terminal 46 provide for partial or complete shunting of this portion of the inductor. The position of the potentiometer 64 controls the firing of the SCRs, and hence determines how effective the first few turns of the inductor are. The wattage of the lamp can be controlled between 1.0 KW to 8.4 KW. When there is a supply voltage of 230–240 volts the tap 42 is connected to the first connection on the inductor 40. When there is a lower supply voltage of 215–225 volts, then the tap is moved over to the next connector. At least some of the windings of the inductor 40 always remain in series with the lamp to protect the lamp during long term operation. The tap 38 is engageable with any of three contacts, and is factory-set in accordance with the model testing apparatus in which the circuit is to be incorportated. The three models are nominally 6500 watts, 3500 watts and 2500 watts. The specification limit of the 6500 watt model is 8.4 KW, but the circuit is capable of going to 9.0 KAW. The limiting factors are wire size, etc. not the design of the lamp circuit.

As has been noted, manufacturing costs are greatly decreased, specifically comparing with an older model from \$250 to \$117 in cost. Operating costs are also greatly reduced, since the booster transformer in the prior circuit drew 10 amps at idle, and this is avoided in the present circuit.

The specific example of the invention as shown and described is for illustrative purposes only. Various changes in structure will no doubt occur to those skilled in the art, and will be understood as forming a part of the present invention insofar as they fall within the spirit and scope of the appended claims.

The invention is claimed as follows:

1. A Xenon lamp circuit for use in testing materials, such as for fading qualities, comprising a pair of conductors for connection to an AC power supply, a Xenon lamp having a pair of terminals, means connecting one of said terminals to one of said conductors, an inductor having first, second and third connectors, means connecting said first connector to the other of said conductors, means connecting said third connector to the other of said Xenon lamp terminals, means including controlled conducting means connected from said second connector to one of said first and third connectors, and means for controlling said controlled conducting means to effect more or less shunting of said inductor between said one and said second conductor to control power input to said Xenon lamp, and further including capacitor means, means connecting said capacitor means substantially in parallel with said lamp for a predetermined time during ignition of said lamp, and means subsequently connecting at least a part of said capacitor means across said conductors for power factor control.

2. A Xenon lamp circuit as set forth in claim 1 wherein said capacitor means comprises a plurality of capacitors and wherein said means for connecting at least part of said capacitor means across said conductors further include means for removing at least one of said capacitors from said circuit.

3. A Xenon lamp circuit for use in testing materials, such as for fading qualities, comprising a pair of conductors for connection to an AC power supply, a Xenon lamp having a pair of terminals, means connecting one of said terminals to one of said conductors, an inductor having first, second and third conductors, means connecting said first connector to the other of said conductors, means connecting said third connector to the other of said xenon lamp terminals, means including controlled conducting means connected from said second connector to one of said first and third connectors, and means for controlling said controlled conducting means to effect more or less shunting of said inductor between said one and said second conductor to control power input to said Xenon lamp, said controlled conducting means comprising silicon controlled rectifier means, and further including capacitor means, means connecting said capacitor means substantially in parallel with said lamp for a predetermined time during ignition of said lamp, and means subsequently connecting at least a part of said capacitor means across said conductors for power factor control.

* * * * *